US011649993B2

(12) United States Patent
Sung et al.

(10) Patent No.: US 11,649,993 B2
(45) Date of Patent: May 16, 2023

(54) HYBRID THERMAL COOLING SYSTEM

(71) Applicant: INTEL CORPORATION, Santa Clara, CA (US)

(72) Inventors: Gavin Sung, Taichung (TW); Gerry Juan, Taipei (TW); Harish Jagadish, Bangalore (IN); Ivan By Wang, Taipei (TW); Jason Y. Jiang, Taipei (TW); Sammi Wy Liu, New Taipei (TW); Tim Liu, New Taipei (TW); Jeff Ku, Taipei (TW)

(73) Assignee: Intel Corporation, Santa Clara, CA (US)

( * ) Notice: Subject to any disclaimer, the term of this patent is extended or adjusted under 35 U.S.C. 154(b) by 61 days.

(21) Appl. No.: 16/457,229

(22) Filed: Jun. 28, 2019

(65) Prior Publication Data

US 2019/0383528 A1 Dec. 19, 2019

(51) Int. Cl.

| | |
|---|---|
| ***F25B 21/02*** | (2006.01) |
| ***F25B 9/00*** | (2006.01) |
| ***F25B 25/00*** | (2006.01) |

(52) U.S. Cl.

CPC ..... *F25B 21/02* (2013.01); *F25B 9/006* (2013.01); *F25B 25/00* (2013.01)

(58) Field of Classification Search

CPC .... F25B 21/02; F25B 9/006; F25B 2321/023; F25B 2321/0251; F25B 25/00; F28D 15/0275; F28D 15/02; F28D 15/0233; H01L 35/30; H01L 35/32; H05K 7/20709; H05K 7/20836

See application file for complete search history.

(56) References Cited

U.S. PATENT DOCUMENTS

| | | | | |
|---|---|---|---|---|
| 4,253,515 | A * | 3/1981 | Swiatosz | F24F 5/0042 165/104.21 |
| 6,351,382 | B1 * | 2/2002 | Nakanishi | G06F 1/20 361/720 |
| 6,415,612 | B1 * | 7/2002 | Pokharna | F25B 21/02 165/80.2 |
| 11,109,509 | B2 * | 8/2021 | He | F04D 29/422 |
| 2003/0110779 | A1 * | 6/2003 | Otey | F25B 25/00 62/3.2 |
| 2004/0008487 | A1 * | 1/2004 | Hisano | H05K 7/20254 361/690 |
| 2004/0187501 | A1 * | 9/2004 | Sauciuc | H01L 35/00 62/3.7 |
| 2005/0257532 | A1 * | 11/2005 | Ikeda | F25B 21/02 62/3.7 |

(Continued)

FOREIGN PATENT DOCUMENTS

| | | | | |
|---|---|---|---|---|
| EP | 2578741 | A1 * | 4/2013 | A47L 15/0013 |
| JP | 2008180453 | A * | 8/2008 | |
| JP | 2017120170 | A * | 7/2017 | |

*Primary Examiner* — Kun Kai Ma

(74) *Attorney, Agent, or Firm* — Patent Capital Group

(57) ABSTRACT

Particular embodiments described herein provide for an electronic device that can be configured to include a hybrid thermal management system. The hybrid thermal management system can include a heat source, an air mover, a heat sink coupled to the air mover, a thermal electric cooling device (TEC), and a heat pipe. The heat pipe can couple the heat source to the heat sink and to the TEC and transfer heat from the heat source to the heat sink and to the TEC.

17 Claims, 8 Drawing Sheets

(56) References Cited

U.S. PATENT DOCUMENTS

| | | | | |
|---|---|---|---|---|
| 2008/0229758 | A1* | 9/2008 | Lin | F28D 15/0275 62/3.2 |
| 2010/0266885 | A1* | 10/2010 | Lee | H01M 10/6552 429/120 |
| 2010/0269517 | A1* | 10/2010 | Ikeda | F25B 21/02 62/3.7 |
| 2011/0203295 | A1* | 8/2011 | Hsu | F25B 21/02 62/3.2 |
| 2015/0075184 | A1* | 3/2015 | Edwards | F28D 15/0266 62/3.2 |
| 2015/0233647 | A1* | 8/2015 | Quisenberry | H01L 23/467 62/3.7 |
| 2016/0003503 | A1* | 1/2016 | Novisoff | F25B 21/04 |
| 2016/0018139 | A1* | 1/2016 | Olsson | F25B 21/02 62/3.3 |
| 2016/0161155 | A1* | 6/2016 | Guichard | G06F 1/206 62/117 |
| 2017/0191709 | A1* | 7/2017 | Chen | F28D 15/0233 |
| 2018/0059521 | A1* | 3/2018 | Nishimori | G03B 21/204 |
| 2018/0112895 | A1* | 4/2018 | Choi | F25B 21/02 |
| 2018/0335231 | A1* | 11/2018 | Gillen | H01L 35/32 |
| 2020/0352051 | A1* | 11/2020 | He | F04D 29/4246 |

* cited by examiner

HYBRID THERMAL COOLING SYSTEM

TECHNICAL FIELD

This disclosure relates in general to the field of computing and/or device cooling, and more particularly, to a hybrid thermal cooling system.

BACKGROUND

Emerging trends in systems place increasing performance demands on the system. The increasing demands can cause thermal increases in the system. The thermal increases can cause a reduction in device performance, a reduction in the lifetime of a device, and delays in data throughput.

BRIEF DESCRIPTION OF THE DRAWINGS

To provide a more complete understanding of the present disclosure and features and advantages thereof, reference is made to the following description, taken in conjunction with the accompanying figures, wherein like reference numerals represent like parts, in which.

Figure 1:
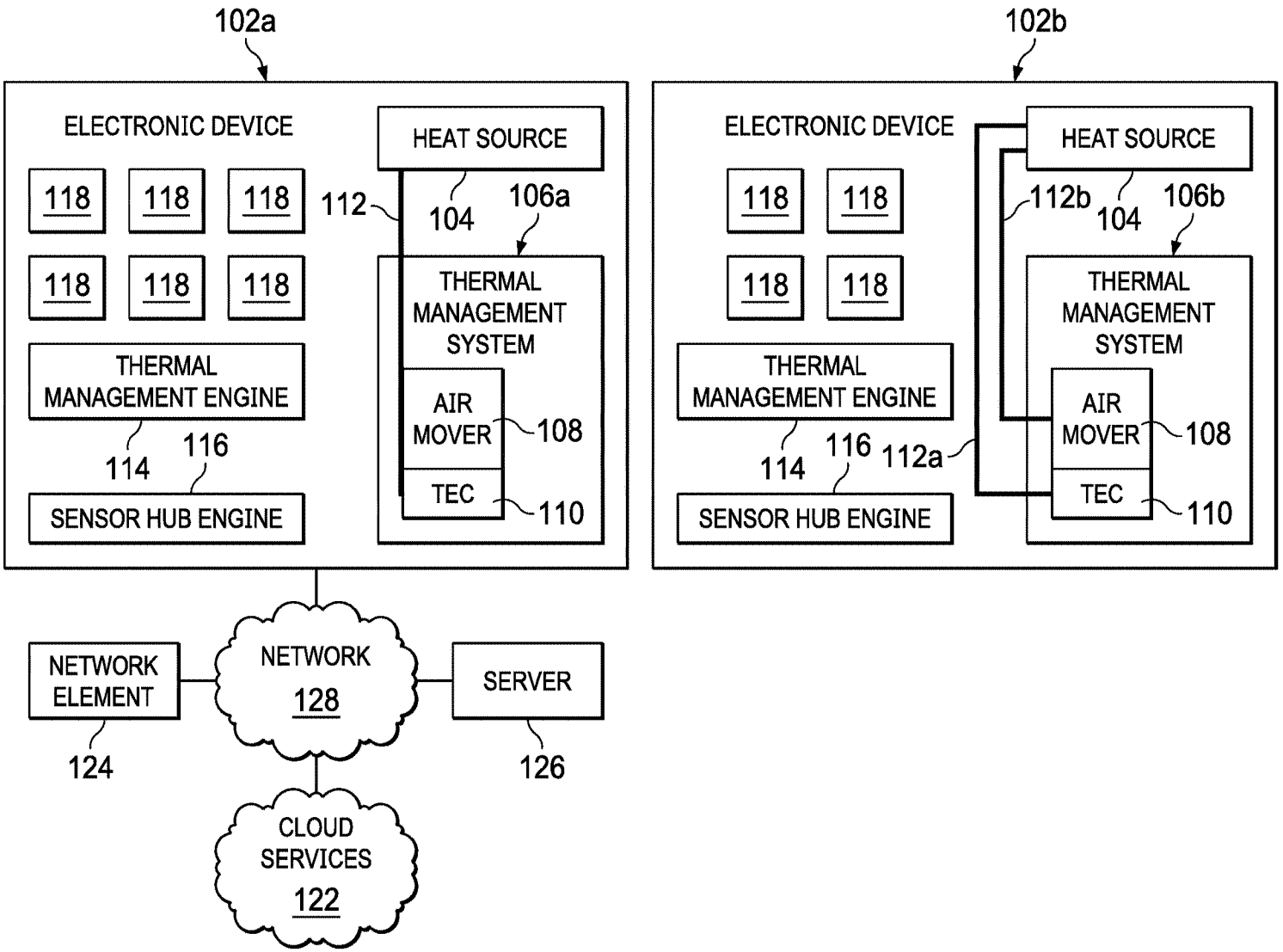
FIG. 1 is a simplified block diagram of a hybrid thermal cooling system, in accordance with an embodiment of the present disclosure.

The FIGURES of the drawings are not necessarily drawn to scale, as their dimensions can be varied considerably without departing from the scope of the present disclosure.

DETAILED DESCRIPTION

Example Embodiments

The following detailed description sets forth examples of apparatuses, methods, and systems relating to enabling a hybrid thermal cooling system. Features such as structure(s), function(s), and/or characteristic(s), for example, are described with reference to one embodiment as a matter of convenience; various embodiments may be implemented with any suitable one or more of the described features.

In the following description, various aspects of the illustrative implementations will be described using terms commonly employed by those skilled in the art to convey the substance of their work to others skilled in the art. However, it will be apparent to those skilled in the art that the embodiments disclosed herein may be practiced with only some of the described aspects. For purposes of explanation, specific numbers, materials, and configurations are set forth in order to provide a thorough understanding of the illustrative implementations. However, it will be apparent to one skilled in the art that the embodiments disclosed herein may be practiced without the specific details. In other instances, well-known features are omitted or simplified in order not to obscure the illustrative implementations.

The terms "over," "under," "below," "between," and "on" as used herein refer to a relative position of one layer or component with respect to other layers or components. For example, one layer disposed over or under another layer may be directly in contact with the other layer or may have one or more intervening layers. Moreover, one layer disposed between two layers may be directly in contact with the two layers or may have one or more intervening layers. In contrast, a first layer "on" a second layer is in direct contact with that second layer. Similarly, unless explicitly stated otherwise, one feature disposed between two features may be in direct contact with the adjacent features or may have one or more intervening layers.

Implementations of the embodiments disclosed herein may be formed or carried out on a substrate, such as a non-semiconductor substrate or a semiconductor substrate. In one implementation, the non-semiconductor substrate may be silicon dioxide, an inter-layer dielectric composed of silicon dioxide, silicon nitride, titanium oxide and other transition metal oxides. Although a few examples of materials from which the non-semiconducting substrate may be formed are described here, any material that may serve as a foundation upon which a non-semiconductor device may be built falls within the spirit and scope of the embodiments disclosed herein.

In another implementation, the semiconductor substrate may be a crystalline substrate formed using a bulk silicon or a silicon-on-insulator substructure. In other implementations, the semiconductor substrate may be formed using alternate materials, which may or may not be combined with silicon, that include but are not limited to germanium, indium antimonide, lead telluride, indium arsenide, indium phosphide, gallium arsenide, indium gallium arsenide, gallium antimonide, or other combinations of group III-V or group IV materials. In other examples, the substrate may be a flexible substrate including 2D materials such as graphene and molybdenum disulphide, organic materials such as pentacene, transparent oxides such as indium gallium zinc oxide poly/amorphous (low temperature of dep) III-V semiconductors and germanium/silicon, and other non-silicon flexible substrates. Although a few examples of materials from which the substrate may be formed are described here, any material that may serve as a foundation upon which a semiconductor device may be built falls within the spirit and scope of the embodiments disclosed herein.

In the following detailed description, reference is made to the accompanying drawings that form a part hereof wherein like numerals designate like parts throughout, and in which is shown, by way of illustration, embodiments that may be practiced. It is to be understood that other embodiments may be utilized and structural or logical changes may be made without departing from the scope of the present disclosure. Therefore, the following detailed description is not to be taken in a limiting sense. For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B, and C).

FIG. 1A is a simplified block diagram of electronic devices configured to enable a hybrid thermal cooling system, in accordance with an embodiment of the present disclosure. In an example, electronic devices 102*a* and 102*b* can include one or more heat sources 104 and a thermal management system. For example, electronic device 102*a* includes thermal management system 106*a* and electronic device 102*b* includes thermal management system 106*b*. Each of thermal management systems 106*a* and 106*b* can include an air mover 108 and a thermal electric cooling device (TEC) 110. Electronic devices 102*a* and 102*b* can also include a thermal management engine 114, a sensor hub engine 116, and one or more electronics 118. A heat pipe can couple heat source 104 to the thermal management system, and more specifically to air mover 108 and TEC 110, to transfer or draw thermal energy away from heat source 104. For example, in electronic device 102*a*, heat pipe 112 couples heat source 104 to air mover 108 and TEC 110 to draw thermal energy away from heat source 104. In electronic device 102*b*, heat pipe 112*a* couples heat source 104 to air mover 108 and heat pipe 112*b* couples heat source 104 to TEC 110 to draw thermal energy away from heat source 104. Air mover 108 and TEC 110 can share a heat sink or each may include a heat sink to help dissipate heat. Each of electronic devices 102*a* and 102*b* may be in communication with one or more network elements or may be a standalone device. For example, as illustrated in FIG. 1, electronic device 102*a* is in communication with cloud services 122, network element 124, and/or server 126 using network 128 while electronic device 102*b* is a standalone device and not connected to network 128. In some examples, electronic device 102*a* may be a standalone device and not connected to network 128. In addition, electronic device 102*b* may be in communication with cloud services 122, network element 124, and/or server 126 using network 128.

Heat source 104 may be a heat generating device (e.g., processor, logic unit, field programmable gate array (FPGA), chip set, a graphics processor, graphics card, battery, memory, or some other type of heat generating device). Thermal management systems 106*a* and 106*b* can be configured as a cooling device to help to reduce the thermal energy or temperature of heat source 104. Air mover 108 can be configured as an air-cooling system and more particularly, as a fan to help reduce the thermal energy or temperature of heat source 104.

TEC 110 can be configured to use a thermoelectric effect (e.g., the Peltier effect) to create a heat flux between the junction of two different types of materials and transfer heat from one side of TEC 110 to the other side of TEC 110. The thermoelectric effect is the presence of heating or cooling at an electrified junction of two different conductors. When a current is made to flow through the junction between the two conductors, heat may be removed at one of the junctions. In an example, the cold zone chassis skin of an electronic device (e.g., electronic device 102*a*) can be utilized for heat dissipation in a controllable way. More specifically, TEC 110 may be configured as an active cooling device and as a heat flux valve or reservoir that allows active control of the chassis' skin temperature by adjusting TEC's 110 power. When needed, TEC's 110 power may be increased to increase the heat dissipation by TEC 110 and cause the cold zone temperature to rise up to a maximum ergonomic thermal limit or decreased to decrease the heat dissipation by TEC 110 and cause the cold zone temperature to decrease or go down.

Heat pipe 112 can be configured to transfer heat from heat source 104 in electronic device 102*a* to thermal management system 106*a* and heat pipes 112*a* and 112*b* can be configured to transfer heat from heat source 104 in electronic device 102*b* to thermal management system 106*b*. Thermal management engine 114 can be configured to independently control air mover 108 and TEC 110. In an example, thermal management engine 114 can be configured to control the velocity or speed of air mover 108. Sensor hub engine 116 can be configured to collect data or thermal parameters related to heat source 104 and other components, elements, devices (e.g., electronics 118) in electronic devices 102*a* and 102*b* and communicate the data to thermal management engine 114. The term "thermal parameters" includes a measurement, range, indicator, etc. of an element or condition that affects the thermal response, thermal state, and/or thermal transient characteristics of the heat source associated with the thermal parameters. The thermal parameters can include a platform workload intensity, a CPU workload or processing speed, a data workload of a neighboring device, fan speed, air temperature (e.g., ambient air temperature, temperature of the air inside the platform, etc.), power dissipation of the device, or other indicators that may affect the thermal condition of the device. Each of electronics 118 can be a device or group of devices available to assist in the operation or function of electronic devices 102*a* and 102*b*.

It is to be understood that other embodiments may be utilized and structural changes may be made without departing from the scope of the present disclosure. Substantial flexibility is provided by electronic devices 102*a* and 102*b* in that any suitable arrangements and configuration may be provided without departing from the teachings of the present disclosure.

As used herein, the term "when" may be used to indicate the temporal nature of an event. For example, the phrase "event 'A' occurs when event 'B' occurs" is to be interpreted to mean that event A may occur before, during, or after the occurrence of event B, but is nonetheless associated with the occurrence of event B. For example, event A occurs when event B occurs if event A occurs in response to the occurrence of event B or in response to a signal indicating that event B has occurred, is occurring, or will occur. Reference to "one embodiment" or "an embodiment" in the present disclosure means that a particular feature, structure, or characteristic described in connection with the embodiment is included in at least one embodiment. The appearances of the phrase "in one embodiment" or "in an embodiment" are not necessarily all referring to the same embodiment.

Network elements of FIG. 1 may be coupled to one another through one or more interfaces employing any suitable connections (wired or wireless), which provide viable pathways for network (e.g., network 128, etc.) communications. Additionally, any one or more of these network elements of FIG. 1 may be combined or removed from the architecture based on particular configuration needs. Network 128 may include a configuration capable of transmission control protocol/Internet protocol (TCP/IP) communications for the transmission or reception of packets in a network. Electronic device 102*a* (and 102*b* if in communication with network 128) may also operate in conjunction with a user datagram protocol/IP (UDP/IP) or any other suitable protocol where appropriate and based on particular needs.

For purposes of illustrating certain example techniques of electronic devices 102*a* and 102*b*, the following foundational information may be viewed as a basis from which the present disclosure may be properly explained. End users have more media and communications choices than ever before. A number of prominent technological trends are currently afoot (e.g., more computing elements, more online video services, more Internet traffic, more complex processing, etc.), and these trends are changing the expected performance of devices as devices and systems are expected to increase performance and function. However, the increase in performance and/or function causes an increase in the thermal challenges of the devices and systems.

For example, in some devices, it can be difficult to cool a particular heat source, especially when the design uses a single central cooling system to cool one or more heat sources and the entire system. More specifically, most current cooling systems are a relatively simple mechanism that depend entirely on a fan and heat pipe material design. The fan and heat pipe material design have a finite cooling ability and it can be difficult to cool one or more heat sources. Also, if the heat source is a processor, during heavy use of the processor, the fan must run at an increased fan speed to attempt to cool the processor. Due to the increased fan speed, platform power usage and acoustic energy of the device can be higher than needed. What is needed is a device to help mitigate the thermal challenges of a system.

A device to help mitigate the thermal challenges of a system, as outlined in FIG. 1, can resolve these issues (and others). In an example, an electronic device (e.g., electronic device 102*a*) can include a hybrid thermal management system (e.g., thermal management system 106*a*). The hybrid thermal management system can include an air mover (e.g., air mover 108) and a TEC (e.g., TEC 110). A heat pipe (e.g., heat pipe 112) can couple a heat source (e.g., heat source 104) to the air mover and the TEC to transfer or draw thermal energy away from the heat source.

In an example, the air mover is a fan and the fan can be the primary cooler for the system. The fan can be configured to blow heat away from the system and into the environment around the system, including the heat generated by the TEC. In some examples, when the system load is low, a thermal management engine (e.g., thermal management engine 114) can switch to TEC cooling only to reduce fan noise. In a specific illustrative example, the air mover and TEC combination can drop the temperature of a heat source and/or system more than five degrees compared with most current cooling systems that only include a fan.

In an example, the TEC and the cold zone chassis skin of an electronic device can be utilized for heat dissipation in a controllable way. More specifically, the TEC may be configured as an active cooling device and as a heat flux valve or reservoir that allows active control of the chassis' skin temperature by adjusting the TEC's power. When needed, the TEC power may be increased to increase the heat dissipation by the TEC and cause the cold zone temperature to rise up to the maximum ergonomic thermal limit or decreased to decrease the heat dissipation by TEC 110 and cause the cold zone temperature to decrease or go down.

The system may include a sensor hub engine (e.g., sensor hub engine 116) that can monitor the system and adjust the air mover and TEC to the most suitable cooling configuration according to environmental conditions while maintaining the system cooling stability. More specifically, the sensor hub engine can be configured to collect or determine thermal parameters for one or more heat sources (e.g., heat source 104). The sensor hub engine can continually update the thermal parameters for each heat source according to changing conditions. The thermal parameters from the heat source can be used by the thermal management engine to control the air mover and the TEC. In an example, the thermal management engine can be configured to anticipate or predict a workload for the heat source and anticipate or predict when the heat source will have a higher temperature and/or workload and adjust the air mover and the TEC accordingly.

Turning to the infrastructure of FIG. 1, network 128 represents a series of points or nodes of interconnected communication paths for receiving and transmitting packets of information. Network 128 offers a communicative interface between nodes, and may be configured as any local area network (LAN), virtual local area network (VLAN), wide area network (WAN), wireless local area network (WLAN), metropolitan area network (MAN), Intranet, Extranet, virtual private network (VPN), and any other appropriate architecture or system that facilitates communications in a network environment, or any suitable combination thereof, including wired and/or wireless communication.

In network 128, network traffic, which is inclusive of packets, frames, signals, data, etc., can be sent and received according to any suitable communication messaging protocols. Suitable communication messaging protocols can include a multi-layered scheme such as Open Systems Interconnection (OSI) model, or any derivations or variants thereof (e.g., Transmission Control Protocol/Internet Protocol (TCP/IP), UDP/IP). Messages through the network could be made in accordance with various network protocols, (e.g., Ethernet, Infiniband, OmniPath, etc.). Additionally, radio signal communications over a cellular network may also be provided. Suitable interfaces and infrastructure may be provided to enable communication with the cellular network.

The term "packet" as used herein, refers to a unit of data that can be routed between a source node and a destination node on a packet switched network. A packet includes a source network address and a destination network address. These network addresses can be Internet Protocol (IP) addresses in a TCP/IP messaging protocol. The term "data" as used herein, refers to any type of binary, numeric, voice, video, textual, or script data, or any type of source or object code, or any other suitable information in any appropriate format that may be communicated from one point to another in electronic devices and/or networks. The data may help determine a status of a network element or network. Additionally, messages, requests, responses, and queries are forms of network traffic, and therefore, may comprise packets, frames, signals, data, etc.

In an example implementation, electronic devices 102*a* and 102*b* are meant to encompass a computer, a personal digital assistant (PDA), a laptop or electronic notebook, a cellular telephone, an iPhone, an IP phone, network elements, network appliances, servers, routers, switches, gateways, bridges, load balancers, processors, modules, or any other device, component, element, or object that includes at least one heat source. Electronic devices 102*a* and 102*b* may each include any suitable hardware, software, components, modules, or objects that facilitate the operations thereof, as well as suitable interfaces for receiving, transmitting, and/or otherwise communicating data or information in a network environment. This may be inclusive of appropriate algorithms and communication protocols that allow for the effective exchange of data or information. Electronic devices 102*a* and 102*b* may each include virtual elements.

In regards to the internal structure, electronic devices 102*a* and 102*b* can each include memory elements for storing information to be used in operations outlined herein. Each of electronic devices 102*a* and 102*b* may keep information in any suitable memory element (e.g., random access memory (RAM), read-only memory (ROM), erasable programmable ROM (EPROM), electrically erasable programmable ROM (EEPROM), application specific integrated circuit (ASIC), etc.), software, hardware, firmware, or in any other suitable component, device, element, or object where appropriate and based on particular needs. Any of the memory items discussed herein should be construed as being encompassed within the broad term 'memory element.' Moreover, the information being used, tracked, sent, or received could be provided in any database, register, queue, table, cache, control list, or other storage structure, all of which can be referenced at any suitable timeframe. Any such storage options may also be included within the broad term 'memory element' as used herein.

In certain example implementations, the functions outlined herein may be implemented by logic encoded in one or more tangible media (e.g., embedded logic provided in an ASIC, digital signal processor (DSP) instructions, software (potentially inclusive of object code and source code) to be executed by a processor, or other similar machine, etc.), which may be inclusive of non-transitory computer-readable media. In some of these instances, memory elements can store data used for the operations described herein. This includes the memory elements being able to store software, logic, code, or processor instructions that are executed to carry out the activities described herein.

In an example implementation, each of electronic devices 102*a* and 102*b* may include software modules (e.g., thermal management engine 114, sensor hub engine 116, etc.) to achieve, or to foster, operations as outlined herein. These modules may be suitably combined in any appropriate manner, which may be based on particular configuration and/or provisioning needs. In example embodiments, such operations may be carried out by hardware, implemented externally to these elements, or included in some other network device to achieve the intended functionality. Furthermore, the modules can be implemented as software, hardware, firmware, or any suitable combination thereof. These elements may also include software (or reciprocating software) that can coordinate with other network elements in order to achieve the operations, as outlined herein.

Additionally, each of electronic devices 102*a* and 102*b* may include a processor that can execute software or an algorithm to perform activities as discussed herein. A processor can execute any type of instructions associated with the data to achieve the operations detailed herein. In one example, the processors could transform an element or an article (e.g., data) from one state or thing to another state or thing. In another example, the activities outlined herein may be implemented with fixed logic or programmable logic (e.g., software/computer instructions executed by a processor) and the elements identified herein could be some type of a programmable processor, programmable digital logic (e.g., a field programmable gate array (FPGA), EPROM, EEPROM) or an ASIC that includes digital logic, software, code, electronic instructions, or any suitable combination thereof. Any of the potential processing elements, modules, and machines described herein should be construed as being encompassed within the broad term 'processor.'

Figure 2A:
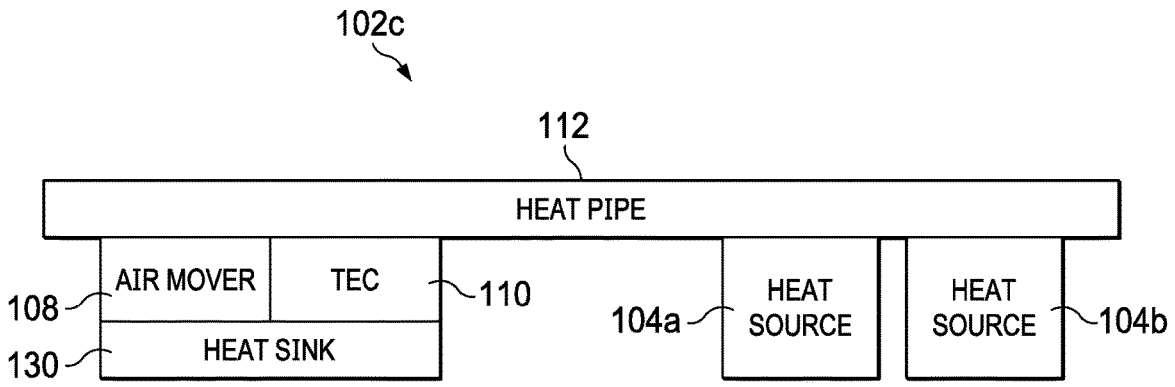
FIG. 2A is a simplified block diagram of a portion of an electronic device that includes a hybrid thermal cooling system, in accordance with an embodiment of the present disclosure.

Turning to FIG. 2A, FIG. 2A is a simplified block diagram of a portion of an electronic device 102*c*. In an example, electronic device 102*c* can include heat sources 104*a* and 104*b*, air mover 108, TEC 110, heat pipe 112, and heat sink 130. Heat pipe 112 can be configured to transfer heat from heat sources 104*a* and 104*b* to air mover 108 and TEC 110. In some examples, heat pipe 112 is configured to transfer heat to heat sink 130. Heat sink 130 can help dissipate the heat collected by air mover 108 and TEC 110 to the environment. Heat sink 130 can also help to dissipate heat generated by TEC 110. Heat sink 130 is configured to dissipate heat into the surrounding environment. In an example, heat sink 130 may be a finned or pinned element or have some other configuration that uses an increased surface area to dissipate the heat to the surrounding environment.

Figure 2B:
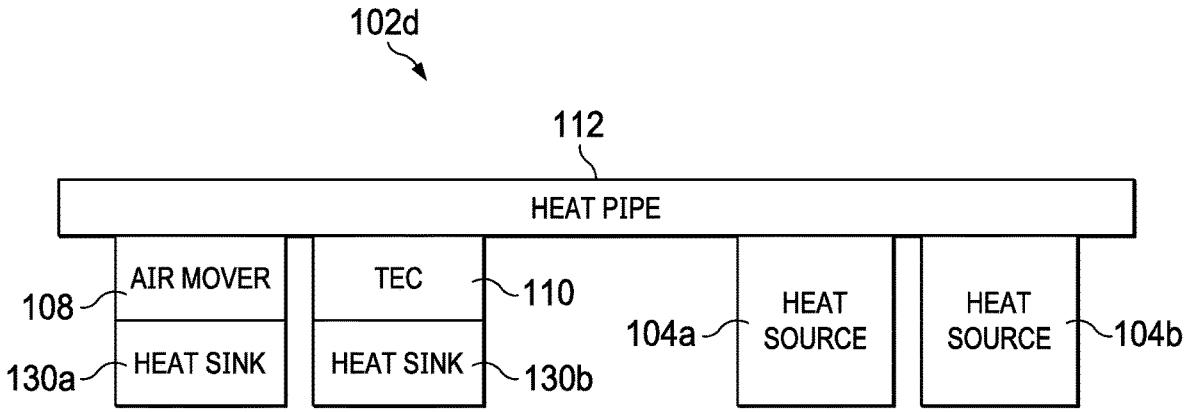
FIG. 2B is a simplified block diagram of a portion of an electronic device that includes a hybrid thermal cooling system, in accordance with an embodiment of the present disclosure.

Turning to FIG. 2B, FIG. 2B is a simplified block diagram of a portion of an electronic device 102*d*. In an example, electronic device 102*d* can include heat sources 104*a* and 104*b*, air mover 108, TEC 110, heat pipe 112, and heat sinks 130*a* and 130*b*. Heat pipe 112 can be configured to transfer heat from heat sources 104*a* and 104*b* to air mover 108 and TEC 110. In some examples, heat pipe 112 is configured to transfer heat to heat sink 130*a*. Heat sink 130*a* can help dissipate the heat collected by air mover 108 to the environment and heat sink 130*b* can help dissipate the heat collected by TEC 110 to the environment. Heat sink 130*b* can also help to dissipate heat generated by TEC 110. Heat sinks 130*a* and 130*b* are configured to dissipate heat into the surrounding environment. In an example, heat sinks 130*a* and 130*b* may be a finned or pinned element or have some other configuration that uses an increased surface area to dissipate the heat to the surrounding environment.

Figure 3A:
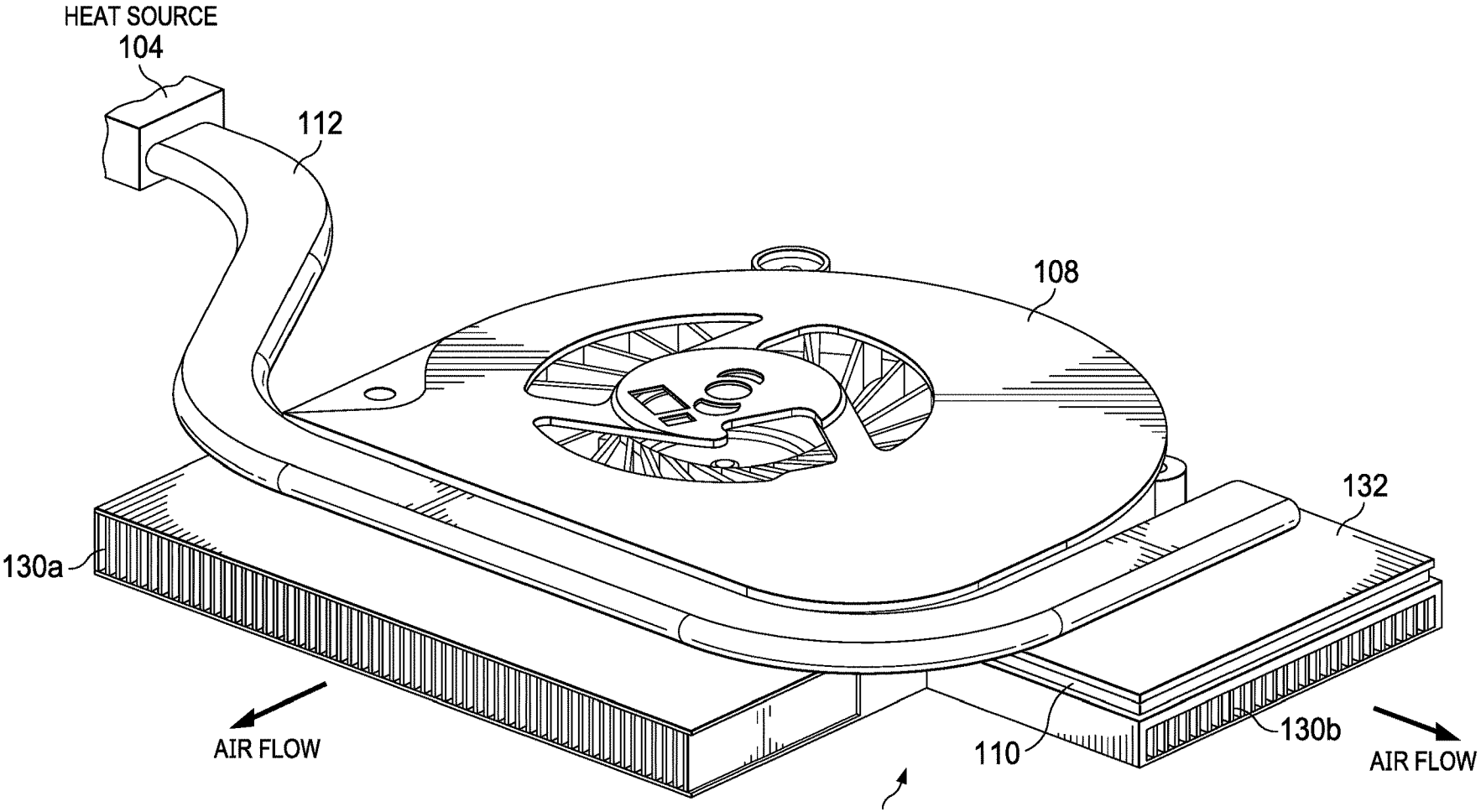
FIG. 3A is a simplified block diagram of a portion of an electronic device that includes a hybrid thermal cooling system, in accordance with an embodiment of the present disclosure.

Turning to FIG. 3A, FIG. 3A is a simplified block diagram of a portion of an electronic device configured to include a thermal management system 106*c*. In an example, heat pipe 112 can couple heat source 104 to thermal management system 106*c*. Thermal management system 106*c* can include air mover 108 and TEC 110. Air mover 108 can be coupled to heat sink 130*a*. TEC 110 can be over heat sink 130*b*. Air mover 108 can be configured to cause air to move over and/or through heat sinks 130*a* and 130*b*.

In an example, a heat spreader 132 can be between heat pipe 112 and TEC 110. Heat spreader 132 can be configured to help transfer the heat from heat source 104 that is captured by heat pipe 112 to TEC 110. Heat spreader 132 may be comprised of copper or some other material that has a relatively high thermal conductivity.

Figure 3B:
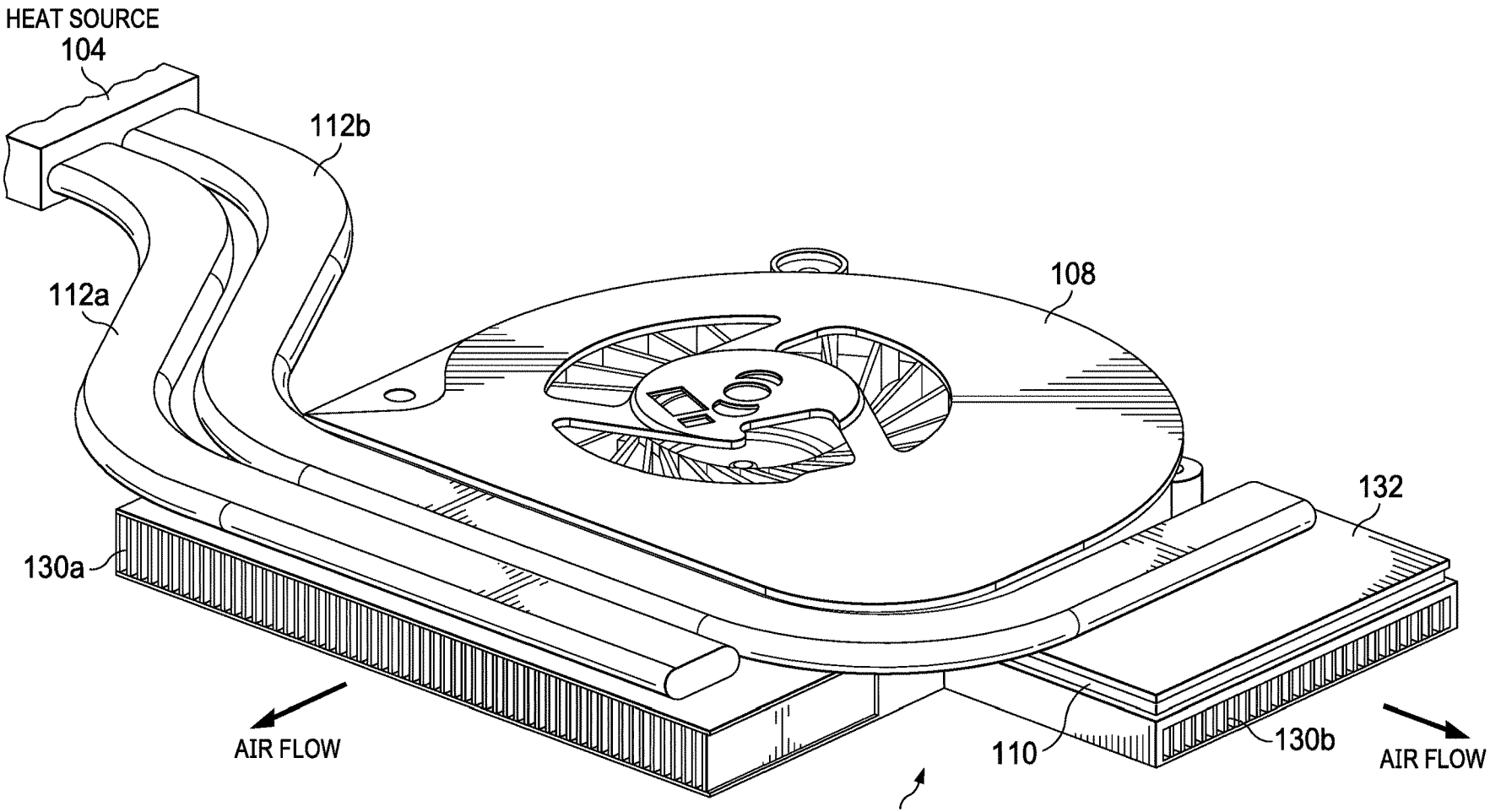
FIG. 3B is a simplified block diagram of a portion of an electronic device that includes a hybrid thermal cooling system, in accordance with an embodiment of the present disclosure.

Turning to FIG. 3B, FIG. 3B is a simplified block diagram of a portion of an electronic device configured to include a thermal management system 106*d*. In an example, heat pipes 112*a* and 112*b* can couple heat source 104 to thermal management system 106*d*. Thermal management system 106*d* can include air mover 108 and TEC 110. Air mover 108 can be coupled to heat sink 130*a*. TEC 110 can be over heat sink 130*b*. Air mover 108 can be configured to cause air to move over and/or through heat sinks 130*a* and 130*b*.

In an example, heat pipe 112*a* may be over or in contact with heat sink 130*a*. In another example, a heat spreader may be between heat pipe 112*a* and heat sink 130*a* to help transfer the heat from heat source 104 that is captured by heat pipe 112 to heat sink 130*a*. In some examples, heat spreader 132 can be between heat pipe 112*b* and TEC 110. Heat spreader 132 can be configured to help transfer the heat from heat source 104 that is captured by heat pipe 112*b* to TEC 110.

Figure 4:
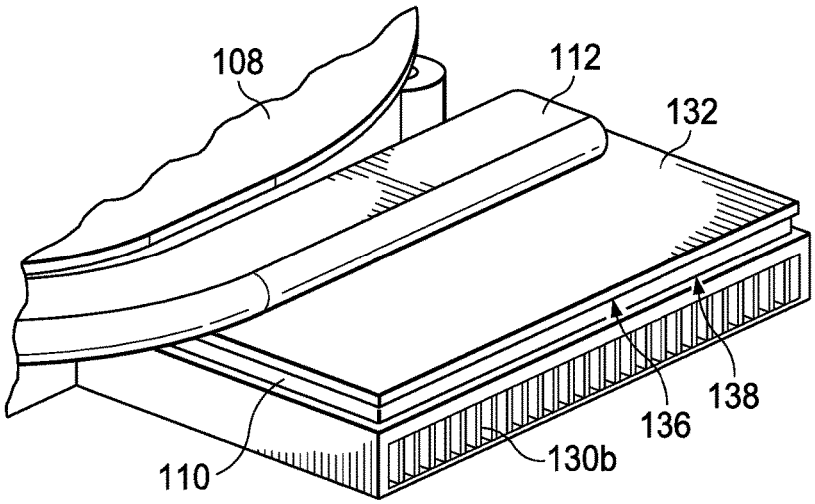
FIG. 4 is a simplified block diagram of a portion of a hybrid thermal cooling system, in accordance with an embodiment of the present disclosure.

Turning to FIG. 4, FIG. 4 is a simplified block diagram of a portion of a thermal management system. TEC 110 is configured to operate by the thermoelectric effect or Peltier effect. TEC 110 has a cold side 136 and a warm side 138. When a current flows through TEC 110, heat from cold side 136 is brought to warm side 138 such that cold side 136 stays relatively cool. As illustrated in FIG. 4, heat spreader 132 can be between heat pipe 112 and TEC 110. More specifically, heat spreader 132 can be over cold side 136 of TEC 110. Warm side 138 can be over heat sink 130*b*.

In an illustrative example, as heat from a heat source is collected by heat pipe 112, the heat, or thermal energy, travels through heat pipe 112 and to heat spreader 132. The heat then transfers from heat pipe 112 to heat spreader 132. From heat spreader 132, the heat transfers to cold side 136 of TEC 110. When a current flows through TEC 110, the heat is transferred from cold side 136 to warm side 138 of TEC 110. The heat can transfer from warm side 138 to heat sink 130*b* where it is dissipated or transferred to the environment or air around heat sink 130*b*. In an example, air mover 108 can cause air to move over or through heat sink 130*b* to help dissipate or transfer the heat to the environment or air.

Figure 5:
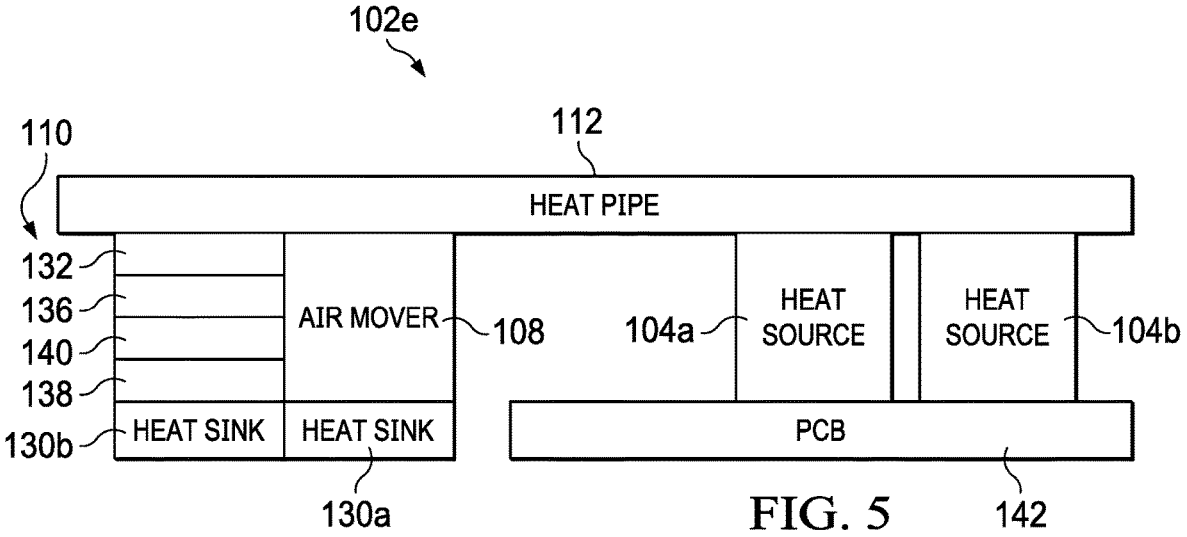
FIG. 5 is a simplified block diagram of a portion of an electronic device that includes a hybrid thermal cooling system, in accordance with an embodiment of the present disclosure.

Turning to FIG. 5, FIG. 5 is a simplified block diagram of a portion of an electronic device 102*e* that includes a thermal management system. In an example, electronic device 102*e* can include heat sources 104*a* and 104*b*, air mover 108, TEC 110, heat pipe 112, heat sink 130*a* and 130*b*, heat spreader 132, and a printed circuit board (PCB) 142. Heat sources 104*a* and 104*b* may be over PCB 142.

Heat pipe 112 can be configured to transfer heat from heat sources 104*a* and 104*b* to air mover 108 and TEC 110. Heat spreader 132 can be between heat pipe 112 and TEC 110 and can be configured to help transfer the heat from heat source 104 that is captured by heat pipe 112 to TEC 110. TEC 110 can include cold side 136, warm side 138, and thermal carriers 140. Heat sink 130*a* can help dissipate the heat collected by air mover 108 to the environment. Heat sink 130*b* can help dissipate the heat collected by TEC 110 to the environment. Heat sink 130*b* can also help to dissipate heat generated by TEC 110.

In an illustrative example, heat from heat source 104*a* and/or 104*b* is collected by heat pipe 112. The heat, or thermal energy, travels through heat pipe 112 to air mover 108 and/or heat spreader 132. The heat then transfers from heat pipe 112 to air mover 108 (or heat sink 130*a*) and/or heat spreader 132. From heat spreader 132, the heat transfers to cold side 136 of TEC 110. When a current flows through TEC 110, thermal carriers 140 are activated and transfer the heat from cold side 136 to warm side 138 of TEC 110. The heat can transfer from warm side 138 to heat sink 130*b* where it is dissipated or transferred to the environment or air around heat sink 130*b*. In an example, air mover 108 can cause air to move over and/or through heat sink 130*b* to help dissipate or transfer the heat to the environment or air.

Figure 6:
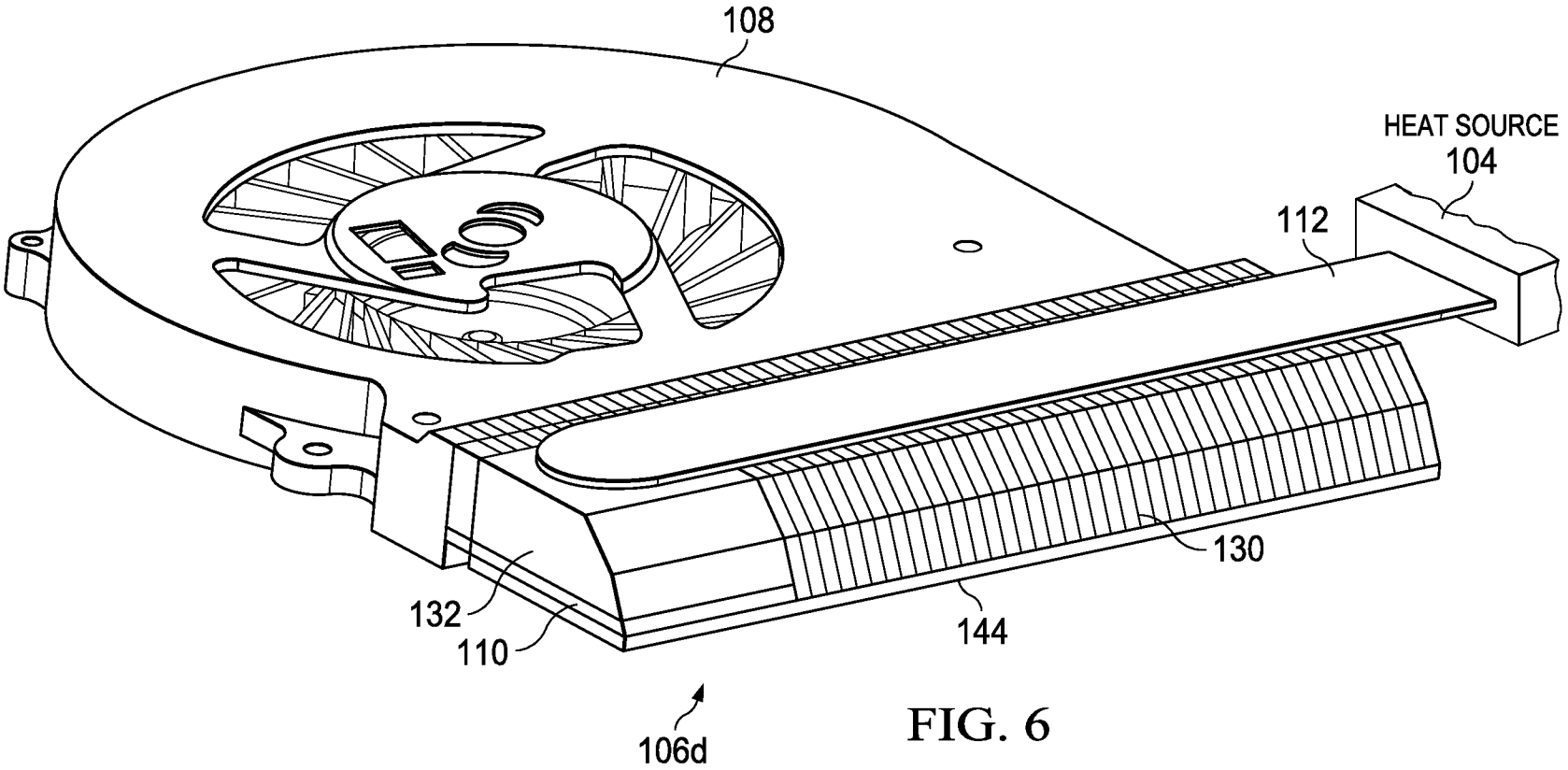
FIG. 6 is a simplified block diagram of a portion of an electronic device that includes a hybrid thermal cooling system, in accordance with an embodiment of the present disclosure.

Turning to FIG. 6, FIG. 6 is a simplified block diagram of a portion of an electronic device configured to include a thermal management system 106*d*. In an example, heat pipe 112 can couple heat source 104 to thermal management system 106*d*. Thermal management system 106*d* can include air mover 108, TEC 110, heat sink 130, heat spreader 132, and a TEC heat pipe 144. Air mover 108 can be configured to cause air to move over and/or through heat sink 130.

Heat spreader 132 can be between heat pipe 112 and TEC 110. Heat spreader 132 can be configured to help transfer the heat from heat source 104 that is captured by heat pipe 112 to TEC 110. In an example, heat spreader 132 may also function as a gap filler to fill in the gap between heat pipe 112 and TEC 110. TEC heat pipe 144 can be under warm side 138 of TEC 110. TEC heat pipe 144 can be configured to transfer heat from warm side 138 of TEC 110 to heat sink 130 to help dissipate the heat collected by TEC 110 and the heat generated by TEC 110 to the environment.

Figure 7A:
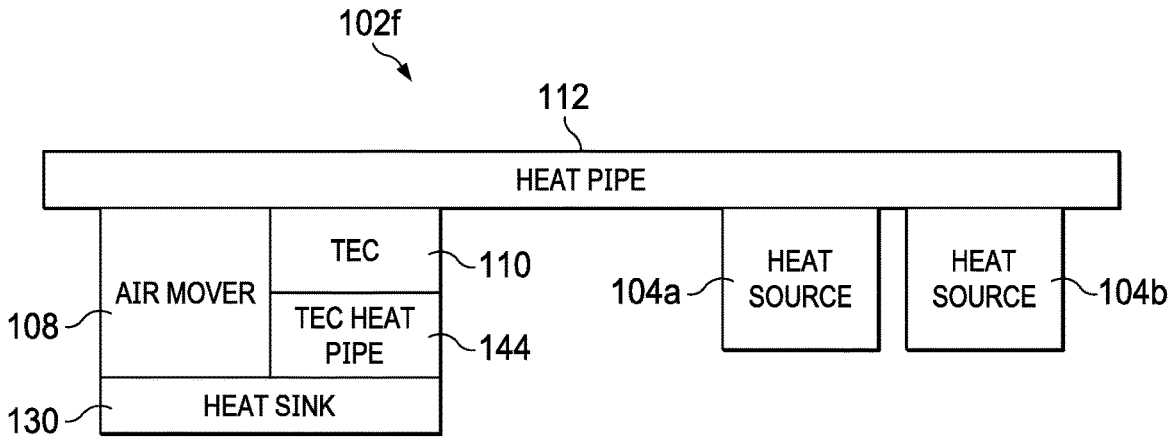
FIG. 7A is a simplified block diagram of a portion of an electronic device that includes a hybrid thermal cooling system, in accordance with an embodiment of the present disclosure.

Turning to FIG. 7A, FIG. 7A is a simplified block diagram of a portion of an electronic device 102*f* that includes a thermal management system that is the same as or similar to thermal management system 106*d* illustrated in FIG. 6. In an example, electronic device 102*f* can include heat sources 104*a* and 104*b*, air mover 108, TEC 110, heat pipe 112, heat sink 130, and TEC heat pipe 144. Heat pipe 112 can be configured to transfer heat from heat sources 104*a* and 104*b* to air mover 108 and TEC 110. TEC heat pipe 144 can be configured to transfer heat from warm side 138 of TEC 110 to heat sink 130. Heat sink 130 can help dissipate the heat collected by air mover 108 to the environment. Heat sink 130 can also help to dissipate heat collected and generated by TEC 110 to the environment.

Figure 7B:
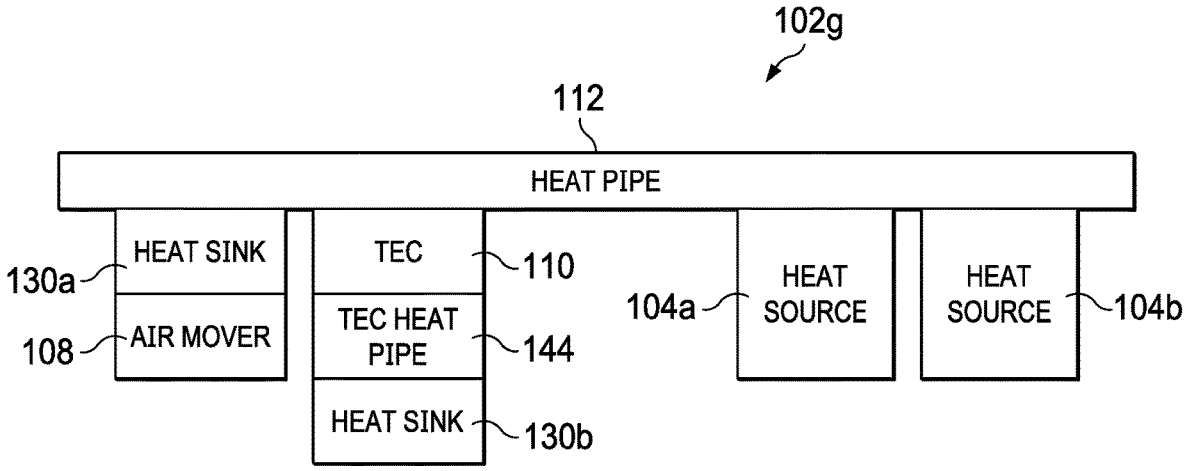
FIG. 7B is a simplified block diagram of a portion of an electronic device that includes a hybrid thermal cooling system, in accordance with an embodiment of the present disclosure.

Turning to FIG. 7B, FIG. 7B is a simplified block diagram of a portion of an electronic device 102*g* that includes a thermal management system that is similar to thermal management system 106*d* illustrated in FIG. 6. In an example, electronic device 102*g* can include heat sources 104*a* and 104*b*, air mover 108, TEC 110, heat pipe 112, heat sinks 130*a* and 130*b*, and TEC heat pipe 144. Heat pipe 112 can be configured to transfer heat from heat sources 104*a* and 104*b* to air mover 108 and TEC 110. Heat sink 130*a* can help dissipate the heat collected by air mover 108 to the environment. TEC heat pipe 144 can be configured to transfer heat from warm side 138 of TEC 110 to heat sink 130*b* and heat sink 130*b* can help dissipate the heat collected and generated by TEC 110 to the environment.

Figure 8:
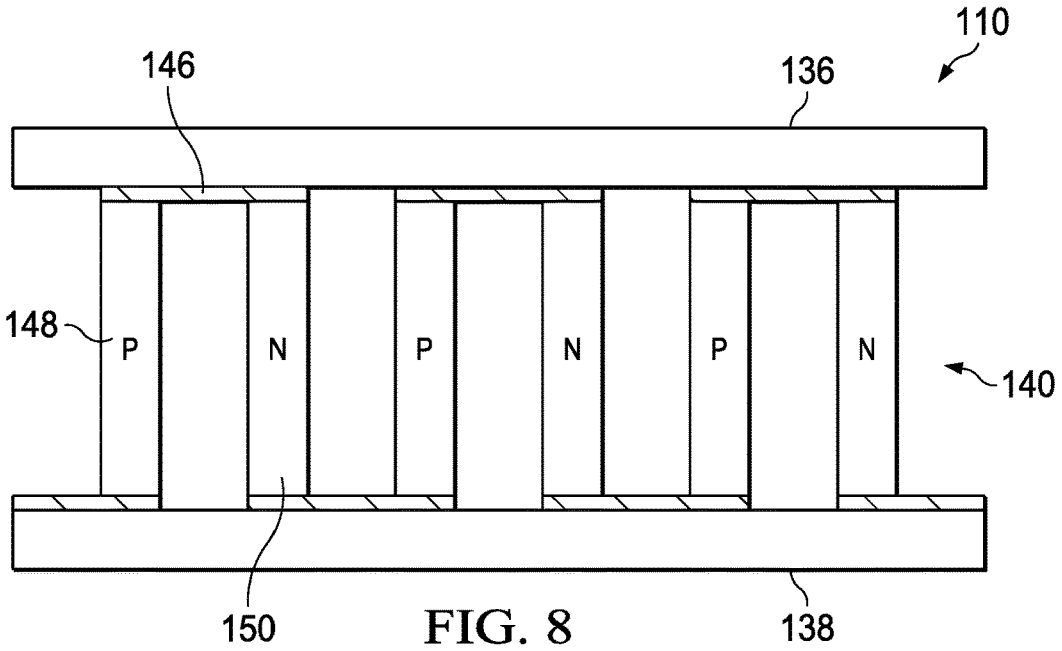
FIG. 8 is a simplified block diagram of a portion of a hybrid thermal cooling system, in accordance with an embodiment of the present disclosure.

Turning to FIG. 8, FIG. 8 is a simplified block diagram of TEC 110. TEC 110 can include cold side 136, warm side 138, and thermal carriers 140. Thermal carriers 140 can include conductive path 146, one or more first semiconductors 148, and one or more second semiconductors 150. First semiconductor 148 has a first electron density and second semiconductor 150 has a different second electron density. In an example, first semiconductor 148 is a p-type semiconductor and second semiconductor 150 is an n-type semiconductor. In a specific example, first semiconductor 148 and second semiconductor 150 may be comprised of antimony and bismuth alloys or some other material that has a combination of low thermal conductivity and high electrical conductivity. Conductive path 146 electrically couples first semiconductor 148 and second semiconductor 150.

As illustrated in FIG. 8, second semiconductors 150 can be located thermally in parallel with first semiconductors 148 and electrically in series using conductive path 146. When a voltage is applied to TEC 110, there is a flow of direct current (DC) across the junction of the semiconductors causing a temperature difference. The side of TEC 110 that includes cold side 136 absorbs heat which is then moved to the other side of TEC 110 that includes warm side 138.

Figure 9:
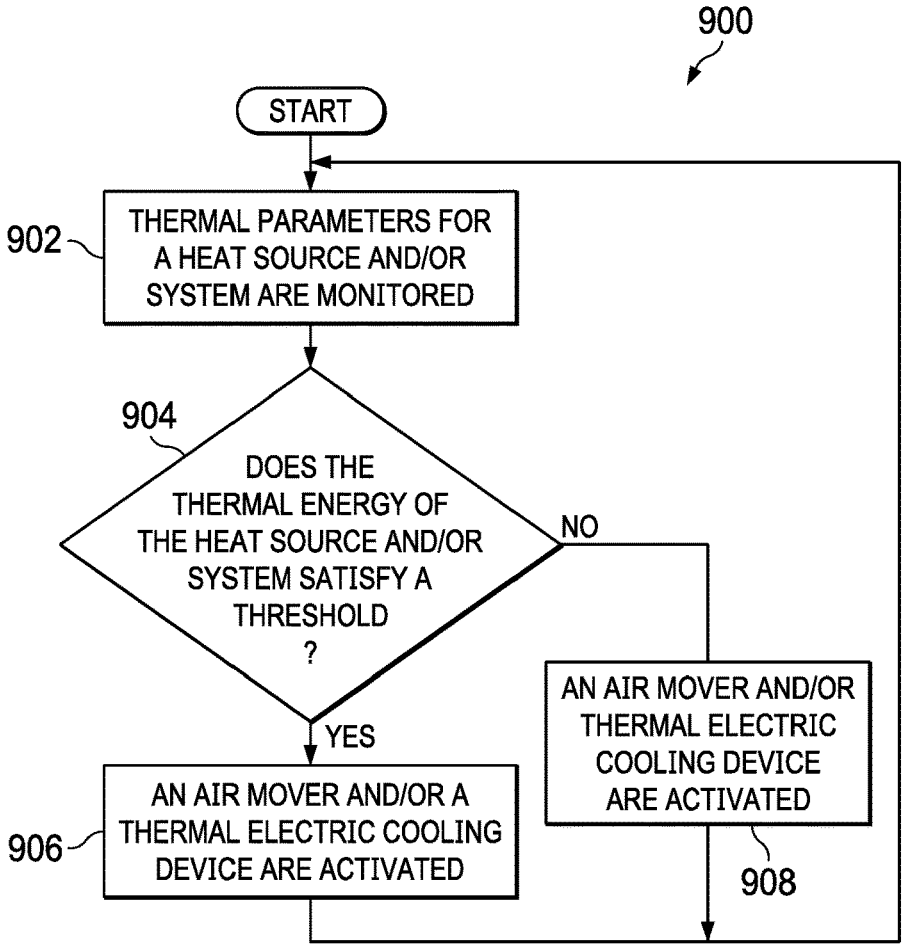
FIG. 9 is a simplified flowchart illustrating potential operations that may be associated with the system in accordance with an embodiment.

Turning to FIG. 9, FIG. 9 is an example flowchart illustrating possible operations of a flow 900 that may be associated with enabling a hybrid thermal cooling system, in accordance with an embodiment. In an embodiment, one or more operations of flow 900 may be performed by thermal management engine 114 and/or sensor hub engine 116. At 902, thermal parameters for a heat source and/or system are monitored. For example, thermal management engine 114 and/or sensor hub engine 116 may monitor the thermal parameters for one or more heat sources (e.g., heat source 104) and/or electronics 118. In another example, thermal management engine 114 and/or sensor hub engine 116 may monitor the thermal parameters for one or more heat sources and an anticipated or predicated workload of the one or more heat sources. At 904, the system determines if the thermal energy of the heat source and/or system satisfies a threshold. For example, thermal management engine 114 can determine if the thermal parameters for the one or more heat sources indicates that the one or more heat sources will be above a predetermined temperature or a temperature that may cause a degradation of the one or more heat sources.

If the thermal energy of the heat source and/or system does satisfy a threshold, then an air mover and/or TEC device are activated, as in 906, and the system returns to 902 where the thermal parameters for a heat source and/or system are monitored. For example, if thermal management engine 114 determines that the thermal parameters for the one or more heat sources indicates that the one or more heat sources will be above a predetermined temperature or a temperature that may cause a degradation of the one or more heat sources, then thermal management engine 114 may activate air mover 108, activate TEC 110, increase the fan speed of air mover 108 if air mover 108 is a fan, increase the power to TEC 110, etc. If the thermal energy of the heat source and/or system does not satisfy a threshold, then the air mover and/or TEC are deactivated, as in 908 and the system returns to 902 where the thermal parameters for a heat source and/or system are monitored. For example, if thermal management engine 114 determines that the thermal parameters for the one or more heat sources indicates that the one or more heat sources will not be above a predetermined temperature or a temperature that may cause a degradation of the one or more heat sources, then thermal management engine 114 may deactivate air mover 108, deactivate TEC 110, decrease the fan speed of air mover 108 if air mover 108 is a fan, decrease the power to TEC 110, etc.

Although the present disclosure has been described in detail with reference to particular arrangements and configurations, these example configurations and arrangements may be changed significantly without departing from the scope of the present disclosure. Moreover, certain components may be combined, separated, eliminated, or added based on particular needs and implementations. For example, electronic devices 102*a*-102*g* may include two or more air movers 108 and/or one or more TECs 110 with each air mover being independently controlled by thermal management engine 114 or controlled as a unit or group. Additionally, although electronic devices 102*a*-102*g* have been illustrated with reference to particular elements and operations that facilitate the thermal cooling process, these elements and operations may be replaced by any suitable architecture, protocols, and/or processes that achieve the intended functionality disclosed herein.

Numerous other changes, substitutions, variations, alterations, and modifications may be ascertained to one skilled in the art and it is intended that the present disclosure encompass all such changes, substitutions, variations, alterations, and modifications as falling within the scope of the appended claims. In order to assist the United States Patent and Trademark Office (USPTO) and, additionally, any readers of any patent issued on this application in interpreting the claims appended hereto, Applicant wishes to note that the Applicant: (a) does not intend any of the appended claims to invoke paragraph six (6) of 35 U.S.C. section 112 as it exists on the date of the filing hereof unless the words "means for" or "step for" are specifically used in the particular claims; and (b) does not intend, by any statement in the specification, to limit this disclosure in any way that is not otherwise reflected in the appended claims.

OTHER NOTES AND EXAMPLES

For the purpose of illustrating different examples embodiments of the hybrid cooling system, following examples illustrate different embodiments that can be associated with the hybrid thermal cooling system of the present disclosure. Although the below examples are described in detail with reference to particular arrangements and configurations, these example configurations and arrangements may be changed significantly without departing from the scope of the present disclosure.

In Example A1, an electronic device can a heat source, an air mover, a heat sink coupled to the air mover, a thermal electric cooling device (TEC), and a heat pipe. The heat pipe couples the heat source to the heat sink and to the TEC and transfers heat from the heat source to the heat sink and to the TEC.

In Example A2, the subject matter of Example A1 can optionally include where the heat pipe includes a first heat pipe that couples the heat source to the heat sink and a second heat pipe that couples the heat source to the TEC.

In Example A3, the subject matter of any one of Examples A1-A2 can optionally include where the heat sink removes heat from the heat pipe and the TEC.

In Example A4, the subject matter of any one of Examples A1-A3 can optionally include a TEC heat pipe, where the TEC heat pipe couples the TEC to the heat sink.

In Example A5, the subject matter of any one of Examples A1-A4 can optionally include a second heat sink coupled to the TEC, wherein the second heat sink removes heat from the TEC.

In Example A6, the subject matter of any one of Examples A1-A5 can optionally include a thermal management engine, wherein the thermal management engine controls the air mover and the TEC.

In Example A7, the subject matter of any one of Examples A1-A6 can optionally include a second heat source, wherein the heat pipe couples the second heat source to the heat sink and to the TEC and transfers heat from the second heat source to the heat sink and to the TEC.

In Example A8, the subject matter of any one of Examples A1-A7 can optionally include where air blown from the air mover cools the TEC.

Example M1 is a method including receiving data related to thermal parameters of a heat source, activating an air mover based on the received data, receiving updated data related to updated thermal parameters of the heat source, and activating a thermal electric cooling device (TEC) based on the received updated data, where a heat pipe couples the heat source to the air mover and to the TEC and transfers heat from the heat source to the air mover and to the TEC.

In Example M2, the subject matter of Example M1 can optionally include removing heat from the heat pipe and the TEC using a heat sink.

In Example M3, the subject matter of any one of the Examples M1-M2 can optionally include a TEC heat pipe couples the TEC to the heat sink.

In Example M4, the subject matter of any one of the Examples M1-M3 can optionally include removing heat from the heat pipe using a first heat sink coupled to the air mover and removing heat from the TEC using a second heat sink coupled to the TEC.

In Example M5, the subject matter of any one of the Examples M1-M4 can optionally include receiving second updated data related to updated thermal parameters of the heat source and de-activating the TEC based on the received second updated data.

Example S1 is a system for thermal management of one or more heat sources. The system can include an air mover, a thermal electric cooling device (TEC) and a heat pipe. The heat pipe couples at least one heat source from the one or more heat source to the air mover and the TEC and transfers heat from the at least one heat source to the air mover and to the TEC.

In Example S2, the subject matter of Example S1 can optionally include where a thermal management engine controls the air mover and the TEC.

In Example S3, the subject matter of any one of the Examples S1-S2 can optionally include where the air mover includes a heat sink and the heat sink removes heat from the heat pipe and the TEC.

In Example S4, the subject matter of any one of the Examples S1-S3 can optionally include a TEC heat pipe, where the TEC heat pipe couples the TEC to the heat sink.

In Example S5, the subject matter of any one of the Examples S1-S4 can optionally include a first heat sink, coupled to the air mover, wherein the first heat sink removes heat from the heat pipe and a second heat sink coupled to the TEC, wherein the second heat sink removes heat from the TEC.

In Example S6, the subject matter of any one of the Examples S1-S5 can optionally include a second heat source, wherein the heat pipe couples the second heat source to the air mover and the TEC and transfers heat from the second heat source to the air mover and the TEC.

In Example S7, the subject matter of any one of the Examples S1-S6 can optionally include where air blown from the air mover cools the TEC.

Example AA1 is an apparatus including means for receiving data related to thermal parameters of a heat source, means for activating an air mover based on the received data, means for receiving updated data related to updated thermal parameters of the heat source, and means for activating a thermal electric cooling device (TEC) based on the received updated data, wherein a heat pipe couples the heat source to the air mover and to the TEC and transfers heat from the heat source to the air mover and to the TEC.

In Example AA2, the subject matter of Example AA1 can optionally include means for removing heat from the heat pipe and the TEC using a heat sink.

In Example AA3, the subject matter of any one of Examples AA1-AA2 can optionally include where a TEC heat pipe couples the TEC to the heat sink.

In Example AA4, the subject matter of any one of Examples AA1-AA3 can optionally include means for removing heat from the heat pipe using a first heat sink coupled to the air mover and removing heat from the TEC using a second heat sink coupled to the TEC.

In Example AA5, the subject matter of any one of Examples AA1-AA4 can optionally include means for receiving second updated data related to updated thermal parameters of the heat source and de-activating the TEC based on the received second updated data.

Example X1 is a machine-readable storage medium including machine-readable instructions to implement a method or realize an apparatus as in any one of the Examples AA1-AA5, or M1-M5. Example Y1 is an apparatus comprising means for performing any of the Example methods M1-M5. In Example Y2, the subject matter of Example Y1 can optionally include the means for performing the method comprising a processor and a memory. In Example Y3, the subject matter of Example Y2 can optionally include the memory comprising machine-readable instructions.

What is claimed is:

1. An electronic device comprising:

a heat source;

an air mover having a first outlet and a second outlet;

a first heat sink coupled to the first outlet of the air mover, wherein a first stream of exhaust air from the air mover moves over and/or through the first heat sink;

a second heat sink coupled to the second outlet of the air mover, wherein a second stream of exhaust air from the air mover moves over and/or through the second heat sink;

a thermal electric cooling device (TEC) adjacent to the air mover and disposed over the second heat sink; and a heat pipe, wherein the heat pipe couples the heat source to the first heat sink and to the TEC and transfers heat from the heat source to the first heat sink and to the TEC.

2. The electronic device of claim 1, wherein the heat pipe includes:

a first heat pipe that couples the heat source to the first heat sink; and a second heat pipe that couples the heat source to the TEC.

3. The electronic device of claim 1, wherein the second heat sink removes heat from the TEC.

4. The electronic device of claim 1, further comprising:

a TEC heat pipe, wherein the TEC heat pipe couples the TEC to the second heat sink.

5. The electronic device of claim 1, further comprising:

a thermal management engine, wherein the thermal management engine controls the air mover and the TEC.

6. The electronic device of claim 1, wherein the heat pipe is coupled to a first side of the TEC and the second heat sink is coupled to a second side of the TEC, wherein the first side of the TEC is opposite the second side of the TEC.

7. A system for thermal management of one or more heat sources, the system comprising:

an air mover having a first outlet and a second outlet;

a first heat sink coupled to the first outlet of the air mover, wherein exhaust air from the air mover moves over and/or through the first heat sink;

a second heat sink coupled to the second outlet of the air mover, wherein exhaust air from the air mover moves over and/or through the second heat sink;

a thermal electric cooling device (TEC) adjacent to the air mover and over the second heat sink; and a heat pipe, wherein the heat pipe couples at least one heat source from the one or more heat source to the first heat sink and to the TEC and transfers heat from the at least one heat source to the first heat sink and to the TEC.

8. The system of claim 7, wherein a thermal management engine controls the air mover and the TEC.

9. The system of claim 7, further comprising:

a TEC heat pipe, wherein the TEC heat pipe couples the TEC to the second heat sink.

10. The system of claim 7, further comprising:

a second heat source, wherein the heat pipe couples the second heat source to the air mover and the TEC and transfers heat from the second heat source to the air mover and the TEC.

11. An electronic device comprising:

a heat source;

an air mover having a first outlet and a second outlet;

a first heat sink coupled to the first outlet of the air mover, wherein a first stream of exhaust air from the air mover moves over and/or through the first heat sink;

a second heat sink coupled to the second outlet of the air mover, wherein a second stream of exhaust air from the air mover moves over and/or through the second heat sink;

a thermal electric cooling device (TEC) adjacent to the air mover;

a heat pipe, wherein the heat pipe couples the heat source to the first heat sink and to the TEC and transfers heat from the heat source to the first heat sink and to the TEC; and a second heat source, wherein the heat pipe couples the second heat source to the second heat sink and to the TEC and transfers heat from the second heat source to the second heat sink and to the TEC.

12. The electronic device of claim 11, wherein the heat pipe includes:

a first heat pipe that couples the heat source to the first heat sink; and a second heat pipe that couples the heat source to the TEC.

13. The electronic device of claim 11, wherein the second heat sink removes heat from the TEC.

14. The electronic device of claim 11, further comprising:

a TEC heat pipe, wherein the TEC heat pipe couples the TEC to the second heat sink.

15. The electronic device of claim 11, further comprising:

a thermal management engine, wherein the thermal management engine controls the air mover and the TEC.

16. The electronic device of claim 11, wherein the TEC is disposed over the second heat sink.

17. The electronic device of claim 11, wherein the heat pipe is coupled to a first side of the TEC and the second heat sink is coupled to a second side of the TEC, wherein the first side of the TEC is opposite the second side of the TEC.

* * * * *